United States Patent [19]

Bender

[11] Patent Number: 4,560,228

[45] Date of Patent: Dec. 24, 1985

[54] ELECTRICAL CONNECTOR FOR SONOBUOY LAUNCH SYSTEM

[75] Inventor: Roland Bender, Furlong, Pa.

[73] Assignee: The United States of America as represented by the Secretary of the Navy, Washington, D.C.

[21] Appl. No.: 503,010

[22] Filed: Jun. 10, 1983

[51] Int. Cl.[4] ..... F41F 5/00

[52] U.S. Cl. ..... 339/147 R; 89/1.51; 367/3; 367/4; 441/11

[58] Field of Search ..... 339/60 C, 60 M, 61 M, 339/255 R, 147 R; 89/1.5 R, 1.811, 1.814; 441/11; 367/3, 4, 5

[56] References Cited

U.S. PATENT DOCUMENTS

| | | | |
|---|---|---|---|
| 2,286,812 | 6/1942 | Keefe | 339/61 M |
| 2,312,083 | 2/1943 | Doane | 339/255 R |
| 2,447,254 | 8/1948 | Jorgenson | 339/255 R |
| 3,016,588 | 1/1962 | Weinhardt et al. | 339/1 R |
| 3,081,701 | 3/1963 | Forquignon et al. | 102/357 |
| 3,213,409 | 10/1965 | Bailey et al. | 367/4 |
| 3,229,311 | 1/1966 | Maes | 441/11 |
| 3,657,681 | 4/1972 | Falkner | 339/61 M |
| 3,671,928 | 6/1972 | Schultz | 441/11 |
| 3,771,110 | 11/1973 | Reed | 339/255 R |
| 3,784,959 | 1/1974 | Horton | 339/60 M |
| 4,271,748 | 6/1981 | Ward | 89/1.814 |

*Primary Examiner*—Gil Weidenfeld
*Assistant Examiner*—Gary F. Paumen
*Attorney, Agent, or Firm*—Robert F. Beers; Henry Hansen

[57] ABSTRACT

A sonobuoy launching system having an electrical connection device for providing a data transmission link between a sonobuoy launch tube and launch container mounted therein. Conductive metal rings are disposed on the end surface of the launch container. A contact-pin device having spring-loaded conductive metal pins is mounted in the breech end of the launch tube. The contact-pin device is oriented such that when the launch container is coupled to the launch tube each of the conductive metal pins will make electrical contact with one of the conductive metal rings.

1 Claim, 8 Drawing Figures

ELECTRICAL CONNECTOR FOR SONOBUOY LAUNCH SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates generally to electrical connection devices and more particularly to a device for electrically interconnecting a sonobuoy launch tube and a sonobuoy launch container mounted therein.

In the process of deploying anti-submarine warfare sonobuoys it is necessary to make certain adjustments to the sonobuoys just prior to deployment (e.g. life span, frequency channel, depth, etc.). It is also desirable to be able to determine the pre-deployment status of such parameters in sonobuoys after they have been loaded in the deploying aircraft launch tubes. A remote function selector system has been devised which utilizes on-board computers which can "talk" with electronic hardward inside the sonobuoys. This system allows the crew in the deploying aircraft to remotely determine the function settings of sonobuoys about to be deployed as well as establish new settings if required.

Sonobuoy deployment means include a launch tube which is structurally connected to the aircraft and a sonobuoy launch container in which the sonobuoy is mounted. The sonobuoy and launch container are mounted in the launch tube prior to the deployment.

Use of the remote function selector system requires a data link through the launch tube and the launch container to the sonobuoy. The sonobuoy launch container is physically separate from the launch tube. The launch container has tabs for interlocking with the launch tube to assure retention both before and after the sonobuoy is deployed. Fast up and down loading of the launch container is essential. Therefore, it is necessary that the data link be easy to connect and disconnect.

Furthermore, due to uncontrollable environmental factors in the aircraft, such as vibration, temperature and humidity, it is necessary that any such data link be highly reliable and able to withstand the adverse effects of such environmental factors.

A previous design approach requires that a flexible brass and flex-circuit harness be fitted over the sonobuoy launch cartridge prior to loading of the sonobuoy into the launch tube. Data is transmitted through the cartridge firing line by using a low level negative voltage (positive voltage being necessary to fire the cartridge). However, this method has a number of drawbacks.

First, the flexible harness is fragile and must be carefully fitted. Second, if not properly fitted, the harness data link is not reliable and is easily damaged. Finally, the harness is compatible with only one of the three currently used deployment aircraft. Extensive modifications would be required to the other types of deployment aircraft in order to utilize the harness method.

Various types of position insensitive, ring or band type electrical connectors have been used on various types of rocket launchers. However, none of these would be suitable because of the requirement of compatibility with existing sonobuoy launch tubes and launch containers.

SUMMARY OF THE INVENTION

Accordingly, it is an object of this invention to transmit data signals between a remote function selector system and an anti-submarine warfare sonobuoy through the sonobuoy launch tube and launch container.

Another object of this invention is to be easily connected or disconnected when the sonobuoy launch container is installed or removed from the launch tube.

A further object of this invention is to assure reliable and efficient data transfer between aircraft avionics and sonobuoy and vice-versa in the face of adverse environmental factors such as vibration, temperature and humidity.

A still further object of this invention is to be completely compatible with and easily adaptable to current design sonobuoy launch tubes and launch containers.

The above and other objects are realized in the present invention with conductive metal rings concentrically disposed in the breech end of a sonobuoy launch container. Wire leads are bonded to the metal rings and provide a means for connecting the rings to a sonobuoy loaded in the launch container. A contact-pin device is mounted in the breech end of the sonobuoy launch tube and has conductive metal pins spring-loaded in a block of electrical insulating material. The block is located in the launch tube breech and the contact-pins are spaced such that when the launch container is coupled to the launch tube the contact-pins will come into direct physical contact with the conductive metal rings thus establishing electrical continuity. The contact-pins are electrically connected to a remote function selector system.

Other objects, advantages, and novel features of the invention will become apparent from the detailed description of the invention which follows the accompanying drawings wherein:

DESCRIPTION OF THE PREFERRED EMBODIMENT

Figure 1:
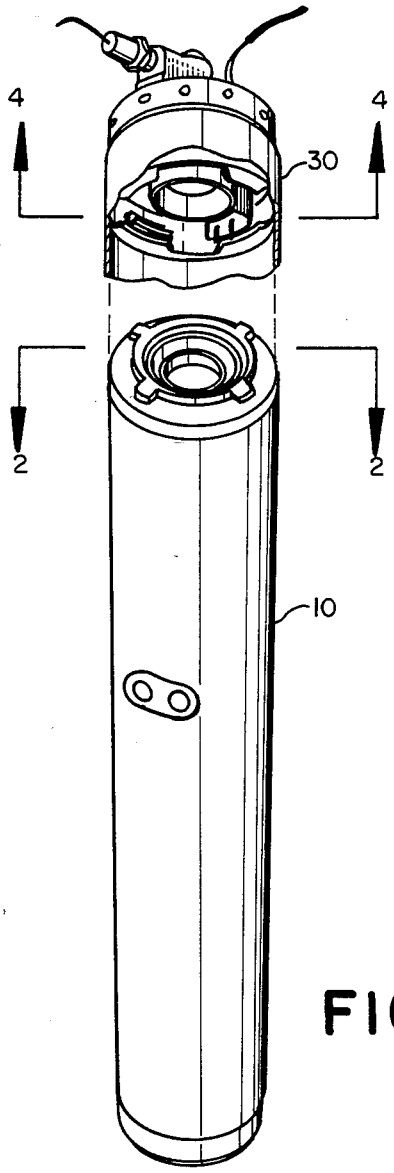
FIG. 1 shows a sonobuoy launch container 10 aligned with the breech end of a sonobuoy launch tube 30.
Figure 2:
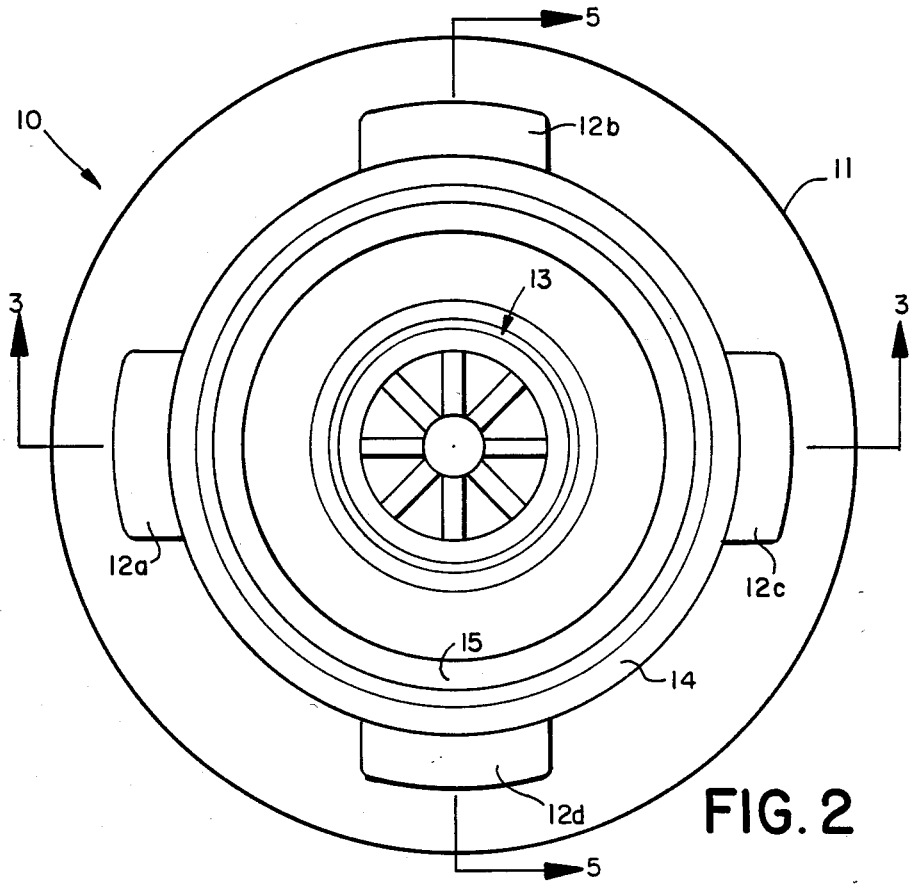
FIG. 2 shows the breech end of the sonobuoy launch container as viewed along the line 2—2 in FIG. 1.
Figure 3:
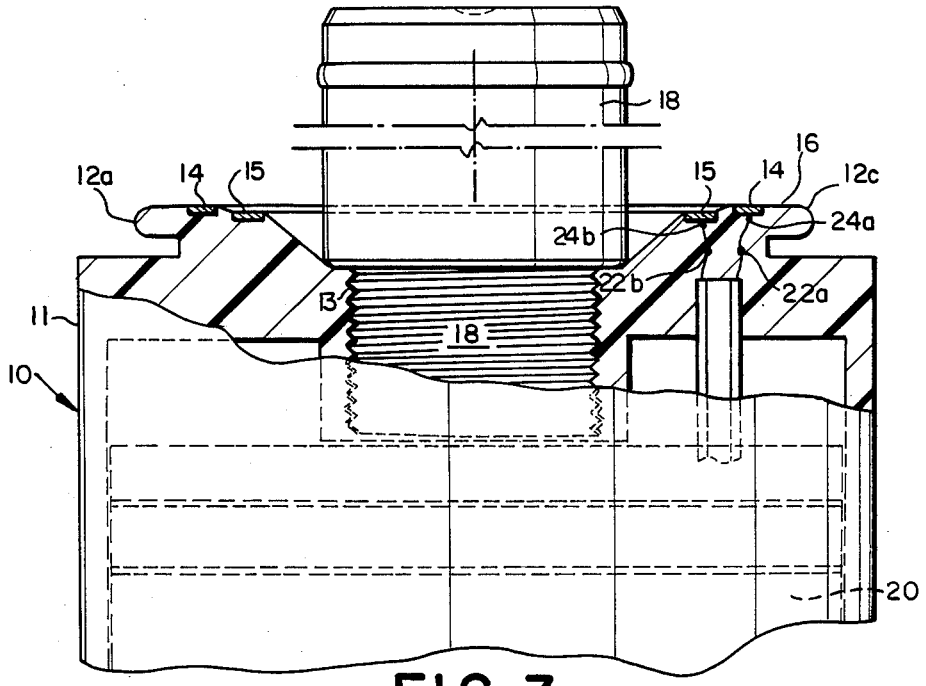
FIG. 3 shows a partial cross-section of the launch container as viewed along the line 3—3 in FIG. 2.

Referring now to the drawings, wherein like reference numerals designate identical or corresponding parts among the several views, and more particularly to FIG. 1, there is shown generally a sonobuoy launch container 10 and the breech end of a sonobuoy launch tube 30. The sonobuoy launch container 10 has a generally cylindrical body 11 as shown in FIGS. 2 and 3. At the end of the sonobuoy launch container 10 there are a plurality of locking tabs 12*a*, 12*b*, 12*c* and 12*d*. These locking tabs are arranged so as to interlock with the sonobuoy launch tube 30.

The sonobuoy launch container 10 also has a threaded recess 13 for receiving a launch cartridge 18. As shown in FIGS. 2 and 3, two rings 14 and 15 are concentrically disposed on the end surface 16 of the sonobuoy launch container 10. The rings 14 and 15 are made of a conductive metal such as copper. The diameter of the rings 14 and 15 are of such dimension that they will fit in the annular region of the end surface 16 between the locking tabs 12*a–d* and the threaded recess 13.

The rings 14 and 15 are embedded in the end surface 16. However, they may also be applied by some other method such as flame spray deposition. Furthermore, it is not necessary that complete rings be used. A plurality of ring-segments would be equally acceptable.

The plane of inner ring 15 is offset slightly from the plane of outer ring 14 in FIGS. 2 and 3, however, the two rings 14 and 15 could also be co-planar depending on particular requirements.

The rings 14 and 15 are electrically connected to a sonobuoy 20 by means of wire leads 22*a*, 22*b*. These wire leads 22*a*, 22*b* are bonded to the interior surfaces of the rings 14 and 15 by solder joints 24*a*, 24*b*. Other methods for connecting the wire leads 22*a*, 22*b* to the rings 14, 15, such as mechanical connectors, could be used as well.

Figure 4:
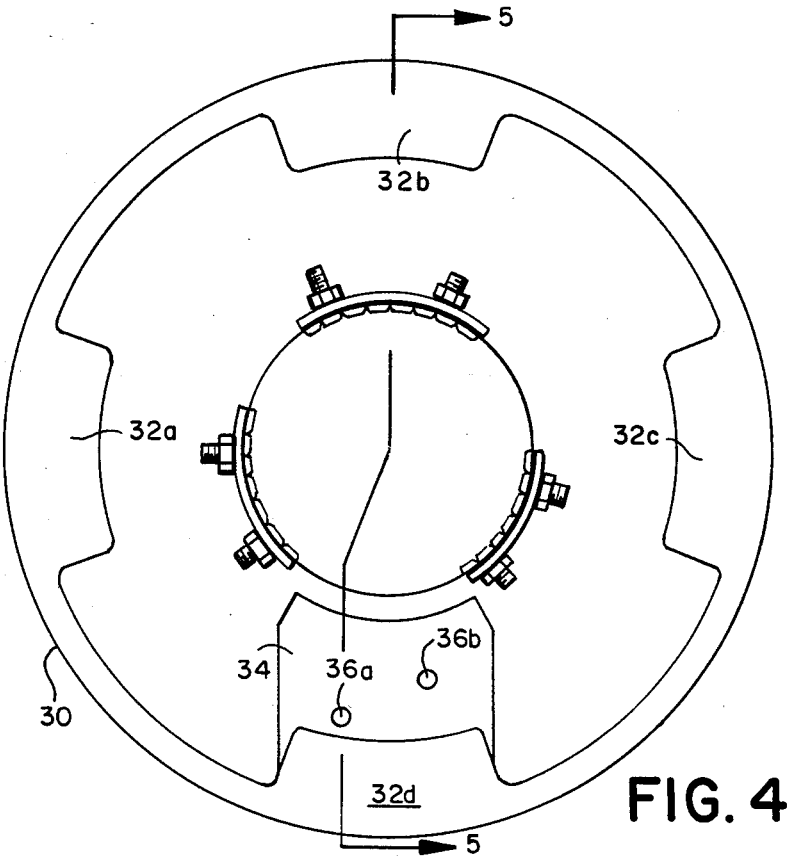
FIG. 4 shows the breech end of the sonobuoy launch tube as viewed along the line 4—4 in FIG. 1.

The conductive metal rings 14 and 15 depicted in FIGS. 2 and 3 provide one half of the connecting device of the invention. The other half is illustrated in FIG. 4 wherein there is shown the breech end of a sonobuoy launch tube 30. The launch tube 30 has locking tabs 32*a*, 32*b*, and 32*c*, and 32*d* which are used for interlocking with the sonobuoy launch container 10.

Mounted inside the launch tube 30 is a contact-pin device 34. This contact-pin device 34 has two contact-pins 36*a* and 36*b* which are resiliently mounted in the device 34.

The contact-pin device 34 is located, and the contact-pins 36*a*, 36*b* are spaced so that they align with the conductive metal rings in the sonobuoy launch container 10.

Figure 5:
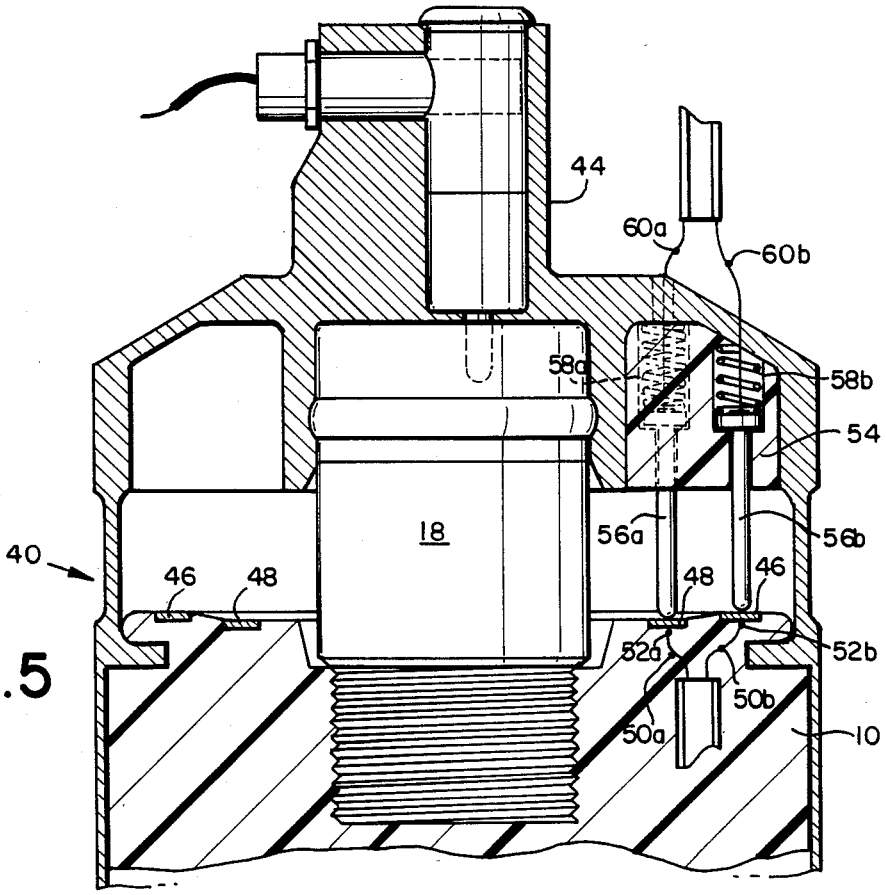
FIG. 5 shows, in partial section, the sonobuoy launch container assembled to the launch tube as viewed along lines 5—5 in FIGS. 2 and 4.

This arrangement is shown more clearly in FIG. 5 which illustrates generally a sonobuoy launch tube/-launch container assembly 40. The assembly 40, consists of a sonobuoy launch container 10 coupled to a sonobuoy launch tube breech 44.

The breech end of container 10 has conductive metal rings 46 and 48 disposed concentrically as described previously. Wire leads 50*a*, 50*b* are connected to the rings 46, 48 by means of solder joints 52*a* and 52*b*.

A contact-pin device 54 is mounted in the launch tube breech 44. The contact-pin device 54 is located such that the contact-pins 56*a* and 56*b* align with the conductive metal rings 46 and 48. Thus, when the launch container 10 is coupled to the launch tube breech end 44, electrical continuity is achieved by the contact-pins 56*a*, 56*b* coming into physical contact with the metal rings 46 and 48 respectively. Good electrical contact is assured by means of the coil springs 58*a*, 58*b* which apply pressure to the contact-pins 56*a*, 56*b* to hold them tightly against the metal rings 46, 48. The contact-pins 56*a*, 56*b* are connected to a remote function selector system on-board the deploying aircraft by means of wire leads 60*a* and 60*b* which are connected to the contact-pins 56*a*, 56*b*.

Figure 6:
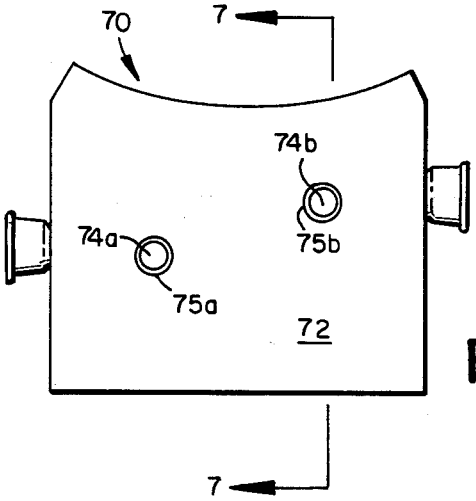
FIG. 6 shows an alternative embodiment of the contact-pin device of the subject invention.
Figure 7:
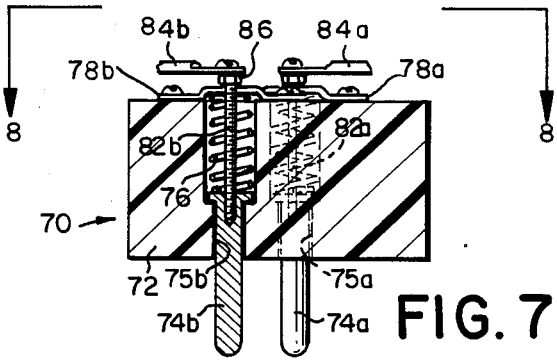
FIG. 7 shows a cross-section of the contact-pin device as viewed along section line 7—7 in FIG. 6.
Figure 8:
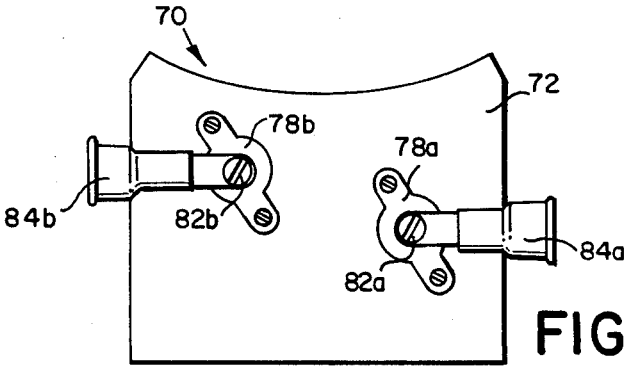
FIG. 8 shows the inward side of the contact-pin device illustrating the spring retaining brackets, terminal lugs and conducting bolts.

An alternative embodiment of the contact-pin device 54 is shown in greater detail in FIGS. 6, 7 and 8. Referring now to FIG. 6, there is shown generally a contact-pin device 70. This contact-pin device 70 includes a block 72 of electrical insulating material such as phenolic plastic or resin. The block 72 has conductive metal pins 74*a* and 74*b*, each of which has one end protruding from boreholes 75*a* and 75*b*.

As shown in FIG. 7, borehole 75*b*, which is representative of both, has dual diameters. Contact-pin 74*b* is flanged at its non-protruding end. This flanged end has a diameter which is larger than the small diameter of borehole 75*b*, but smaller than the large diameter of borehole 75*b*. Thus, when contact-pin 74*b* is inserted into borehole 75*b* as shown in FIG. 6, it is retained due to the inability of the flanged end to traverse the small diameter of borehole 75*b*.

Retaining brackets 78*a* and 78*b*, shown in FIGS. 7 and 8, are fastened by such means as screws or rivets to the inward side of block 72. The retaining brackets 78*a*, 78*b* are themselves used to hold in place coil springs such as 76 shown in FIG. 7. Coil spring 76 is disposed in borehole 75*b* to maintain pressure on the contact-pin 74*b* as discussed previously.

Means for connecting the contact-pin 74*b* to external circuits are provided also. As shown in FIGS. 7 and 8, these connection means are realized by bolts 82*a* and 82*b* which are made of conductive metal. They are inserted through holes in the retaining brackets 78*a*, 78*b* and screwed into threaded recesses.

Additionally, bolts 82*a*, 82*b* are connected to external wire leads (not shown) by terminal lugs 84*a* and 84*b* which are affixed to the bolts 82*a*, 82*b* by means of locknuts 86.

It should be noted that the contact pins may be connected to external circuits by other means. For example, flexible wire leads bonded directly to the flanged ends of the contact pins could also be used.

Numerous additional modifications and variations of the subject invention are possible in light of the above teachings. It is therefore to be understood that within the scope of the appended claims, the invention may be practiced otherwise than as specifically described herein.

What is claimed is:

1. A sonobuoy launching system for aircraft having an onboard, electrical, remote function selector, comprising:

a launch tube formed to be mounted on an aircraft, the breech end of said launch tube having a plurality of locking tabs disposed radially inward about its circumference and resilient electrical contacts radially spaced from the axis of said tube and formed to be operatively connected to the remote function selector; and a sonobuoy container, the breech end of said container having a plurality of locking tabs disposed radially outward and rotatably engaging with said launch tube locking tabs, and having concentric conductive metal surfaces disposed on the breech end and aligned with and engaging respective ones of said contacts, said surfaces being formed to be electrically connected to the sonobuoy whereby the launch container can transfer a plurality of discrete electrical command signals to a sonobuoy from the function selector for programming the sonobuoy for a specific mission.

* * * * *